US010434347B2

(12) United States Patent
Richard et al.

(10) Patent No.: US 10,434,347 B2
(45) Date of Patent: Oct. 8, 2019

(54) FIRE EXTINGUISHING COMPOSITIONS, SYSTEMS AND METHODS

(71) Applicant: HONEYWELL INTERNATIONAL INC., Morris Plains, NJ (US)

(72) Inventors: Robert Gerard Richard, Hamburg, NY (US); Rajiv Ratna Singh, Getzville, NY (US); Ryan Hulse, Getzville, NY (US)

(73) Assignee: HONEYWELL INTERNATIONAL INC., Morris Plains, NJ (US)

( * ) Notice: Subject to any disclaimer, the term of this patent is extended or adjusted under 35 U.S.C. 154(b) by 0 days.

(21) Appl. No.: 15/974,596

(22) Filed: May 8, 2018

(65) Prior Publication Data

US 2018/0318624 A1 Nov. 8, 2018

Related U.S. Application Data

(60) Provisional application No. 62/502,905, filed on May 8, 2017.

(51) Int. Cl.
*A62C 2/00* (2006.01)
*A62D 1/00* (2006.01)

(52) U.S. Cl.
CPC ..... *A62D 1/0028* (2013.01); *A62C 2/00* (2013.01)

(58) Field of Classification Search
CPC ..... A62D 1/0028
See application file for complete search history.

(56) References Cited

U.S. PATENT DOCUMENTS

2011/0144216 A1* 6/2011 Hulse ..... A01N 29/02 514/757
2013/0109771 A1* 5/2013 Hulse ..... C09K 3/00 521/87

* cited by examiner

*Primary Examiner* — Peter F Godenschwager
(74) *Attorney, Agent, or Firm* — Colleen D. Szuch

(57) ABSTRACT

Disclosed are fire extinguishants comprising from about 20% to about 80% by weight of 1-chloro-3,3,3-trifluoropropene (HFO-1233zd) and from about 20% to about 80% by weight of 1,1,1,2,2,4,5,5,5-nonafluoro-4-(trifluoromethyl)-3-pentanone (FK5-1-12), and to methods, systems and containers which use the fire extinguishants.

13 Claims, 2 Drawing Sheets

Exemplary total flooding system

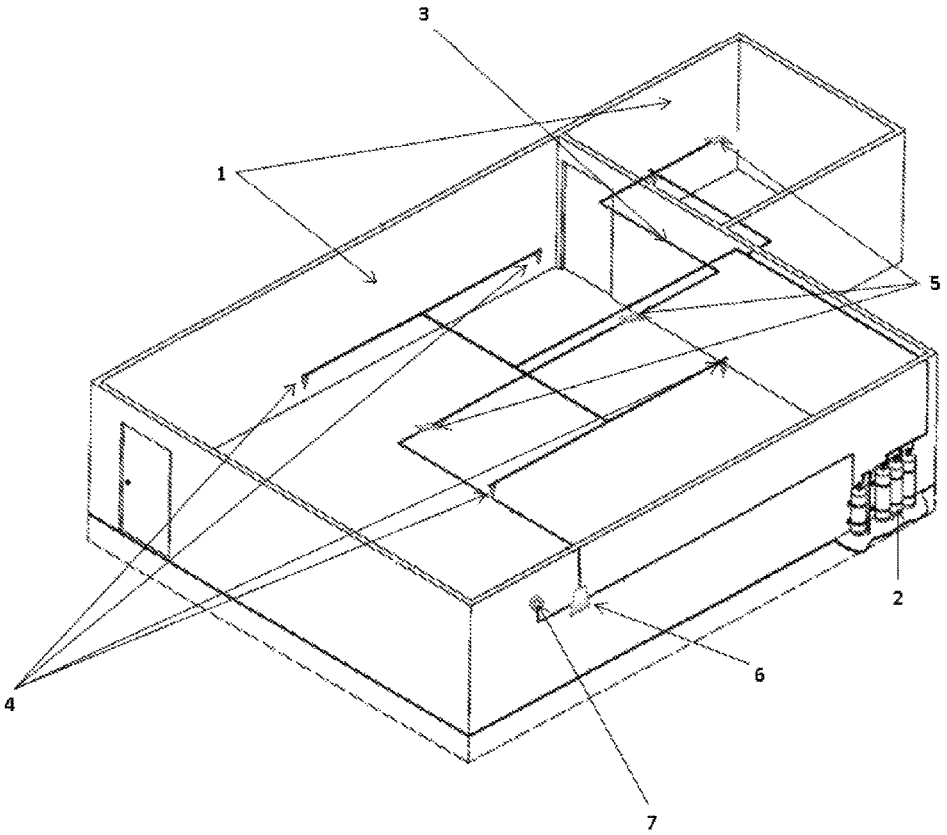
Figure 1 – Exemplary total flooding system

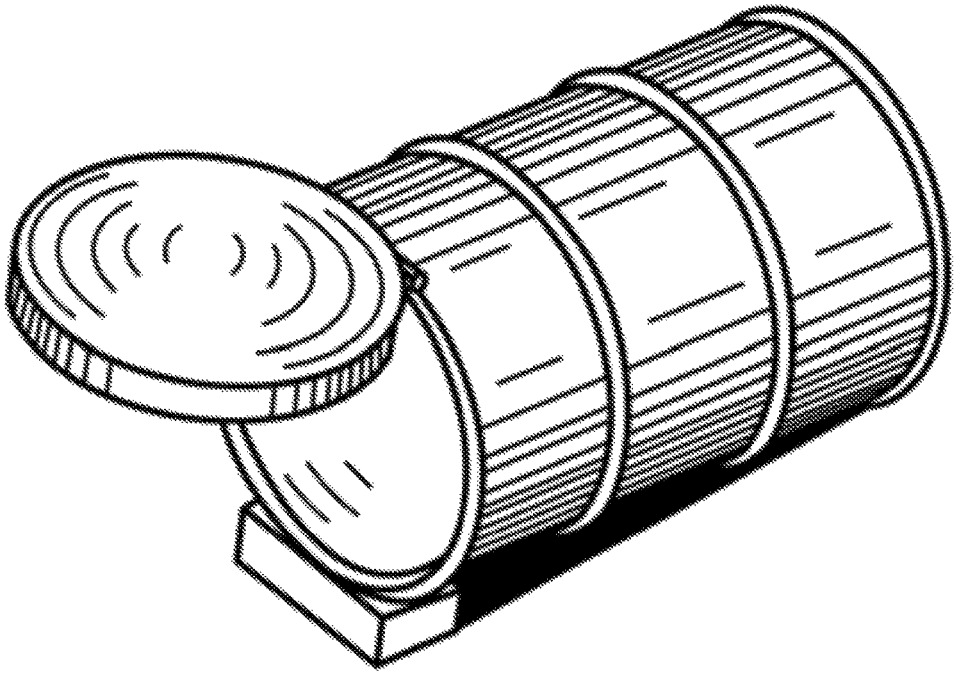
Figure 2 – Drum with hinged lid

FIRE EXTINGUISHING COMPOSITIONS, SYSTEMS AND METHODS

CROSS REFERENCE TO RELATED APPLICATION

The present application claims the priority of U.S. Provisional Application No. 62/502,905, filed May 8, 2017, the entirety of which is herein incorporated by reference.

FIELD OF THE INVENTION

The present invention relates to fire extinguishants, compositions which comprise fire extinguishants, and methods, systems and containers which use fire extinguishants.

BACKGROUND

Numerous agents and methods for suppressing and/orextinguishing fires are known and can be selected for a particular fire, depending upon factors such as size, location and the type of combustible materials involved.

Certain halogenated hydrocarbon extinguishants have been used in the fire protection industry, particularly in applications including total flooding applications, where an enclosed area is completely filled ("flooded") with an effective amount of the agent (e.g., computer rooms, storage vaults, telecommunications switching gear rooms, libraries, document archives, petroleum pipeline pumping stations, and the like), or in streaming applications where the extinguishant is directed towards the location of the fire (e.g., commercial hand-held extinguishers). Such extinguishants are not only effective but, unlike water, also function as "clean extinguishants", causing little, if any, damage to the enclosure or its contents.

Previously, the most commonly-used halogenated hydrocarbon extinguishants have been bromine-containing compounds such as bromotrifluoromethane ($CF_3Br$, Halon 1301) and bromochlorodifluoromethane ($CF_2ClBr$, Halon 1211). While these bromine-containing halocarbons are highly effective in extinguishing fires and can be dispensed either from streaming equipment or from a total flooding system, these compounds have been linked to the destruction of stratospheric ozone ("ozone depletion"). For example, Halon 1301 has an Ozone Depletion Potential (ODP) of about 10, and Halon 1211 has and ODP of about 3. In 1987, a number of governments signed the Montreal Protocol to protect the global environment, setting forth a timetable for phasing out ozone depleting products, including the bromine-containing halocarbons.

Furthermore, certain of these compounds have issues with toxicity even at relatively low concentration levels. For example, Halon 1211 causes cardiac sensitization when used at levels above 1-2% vol in air.

In response to the requirement for a non-flammable, non-toxic alternative to the bromine-containing halocarbons, the industry developed a number of hydrofluorocarbons (HFCs) which have zero ozone depletion potential. For example, 1,1,1,2,3,3,3-heptafluoropropane (HFC-227ea) has been adopted in certain fire extinguishing applications and also does not contribute to ozone depletion.

However, HFC-227ea has a Global Warming Potential (GWP) of about 3220 (according to IPCC (2007) Climate Change 2007: The Physical Science Basis. Contribution of Working Group I to the Fourth Assessment Report of the Intergovernmental Panel on Climate Change. S. Solomon et al., Cambridge University Press. Cambridge, United Kingdom). There is therefore a need in the art for clean fire extinguishants with both a low Ozone Depletion Potential (ODP) and a low Global Warming Potential (GWP) . . . .

It is understood in the art that replacement clean fire extinguishants must possess a mosaic of properties in order to be capable of effectively and safely extinguishing a fire, preferably with minimum unwanted consequences. That mosaic generally includes excellent fire extinguishing properties, as well as chemical stability, low or no toxicity, amongst others. The replacement clean fire extinguishants must also have acceptable environmental properties, i.e. low Global Warming Potential (GWP) and low Ozone Depletion Potential (ODP). However, the identification of a flame extinguishant meeting all of these requirements is presents a significant challenge to those skilled in the art.

It is also desirable to provide a fire extinguishant which is gaseous at room temperature (i.e. about 21° C.), or which has a boiling point at or about room temperature (i.e. about 21° C.), when measured at about atmospheric pressure (i.e. at about 1 atm). Although fire extinguishants which have a boiling point above room temperature (and are therefore liquid when discharged) can be used, a fire extinguishant which has a boiling point at or about room temperature (i.e. about 21° C.) will evaporate more quickly than a fire extinguishant which has a boiling point above room temperature, and thus fill the area surrounding the flame to be extinguished (or the area to be inerted) faster, all other things being equal.

WO02007/002625 discloses that fluoroalkenes of formula (I), $XCF_zR_{3-z}$, can be used in a method of suppressing a flame. Monochloro, trifluoropropenes (HFO-1233), including 1-chloro-3,3,3-triflouropropene (HFO-1233zd), are disclosed as compounds of formula (I).

U.S. Pat. No. 9,387,352 discloses liquid extinguishing/inerting systems for suppressing fire and identifies 1,1,1,2,2,4,5,5,5-nonafluoro-4-(trifluoromethyl)-3-pentanone as a potential liquid extinguishing agent.

Applicants have come to appreciate that the previously available fire suppression compositions, systems and methods have one or more disadvantages. For example, while 1,1,1,2,2,4,5,5,5-nonafluoro-4-(trifluoromethyl)-3-pentanone has a degree of effectiveness in flame suppression, it is also a liquid at room temperature and as a consequence may tend to be deposited as a liquid on surfaces in the fire suppression areas. Such a situation can be disadvantageous in that the materials that are coated with the liquid will subsequently need to be cleaned, or in some cases may need to be repaired or replaced.

BRIEF DESCRIPTION OF THE FIGURES

FIG. 1 illustrates schematically a total flooding system according to one embodiment of the present fire extinguishant methods and systems.

FIG. 2 is a schematic illustrative of the closed drum used in the "closed drum test" described in the Examples hereof.

SUMMARY

Applicants have developed highly advantageous compositions, systems and methods which achieve rapid and effective flame suppression while avoiding one or more of the problems with prior compositions, methods and systems.

The present invention includes compositions comprising HFO-1233zd and 1,1,1,2,2,4,5,5,5-nonafluoro-4-(trifluoromethyl)-3-pentanone (FK5-1-12) in relative proportions which, unexpectedly and surprisingly, have the ability to achieve rapid and effectively flame suppression and at the same time avoiding the problems associated with liquid suppression agents and to methods, systems and containers containing and/or using such compositions in fire extinguishing applications.

The present invention thus includes fire extinguishants comprising from about 20% to about 80% by weight of HFO-1233zd and from about 20% to about 80% by weight of FK5-1-12, wherein the amount of the HFO-1233zd and FKF-1-12 together preferably comprise at least about 80% by weight of the fire extinguishant. For the purposes of convenience, fire extinguishants according to this paragraph are sometimes referred to herein as Fire Extinguishant 1.

The present invention thus includes fire extinguishants comprising from about 20% to about 80% by weight of HFO-1233zd(E) and from about 20% to about 80% by weight of FK5-1-12, wherein the amount of the HFO-1233zd(E) and FKF-1-12 together preferably comprise at least about 80% by weight of the fire extinguishant. For the purposes of convenience, fire extinguishants according to this paragraph are sometimes referred to herein as Fire Extinguishant 1A.

The present invention also includes fire extinguishants comprising from about 20% to about 80% by weight of HFO-1233zd and from about 20% to about 80% by weight of FK5-1-12, wherein the amount of the HFO-1233zd and FKF-1-12 together preferably comprise at least about 90% by weight of the fire extinguishant. For the purposes of convenience, fire extinguishants according to this paragraph are sometimes referred to herein as Fire Extinguishant 2.

The present invention also includes fire extinguishants comprising from about 20% to about 80% by weight of HFO-1233zd(E) and from about 20% to about 80% by weight of FK5-1-12, wherein the amount of the HFO-1233zd(E) and FKF-1-12 together preferably comprise at least about 90% by weight of the fire extinguishant. For the purposes of convenience, fire extinguishants according to this paragraph are sometimes referred to herein as Fire Extinguishant 2A.

The present invention also includes fire extinguishants comprising from about 20% to about 80% by weight of HFO-1233zd and from about 20% to about 80% by weight of FK5-1-12, wherein the amount of the HFO-1233zd and FKF-1-12 together preferably comprise at least about 95% by weight of the fire extinguishant. For the purposes of convenience, fire extinguishants according to this paragraph are sometimes referred to herein as Fire Extinguishant 3.

The present invention also includes fire extinguishants comprising from about 20% to about 80% by weight of HFO-1233zd(E) and from about 20% to about 80% by weight of FK5-1-12, wherein the amount of the HFO-1233zd(E) and FKF-1-12 together preferably comprise at least about 95% by weight of the fire extinguishant. For the purposes of convenience, fire extinguishants according to this paragraph are sometimes referred to herein as Fire Extinguishant 3A.

The present invention also includes fire extinguishants consisting essentially of from about 20% to about 80% by weight of HFO-1233zd and from about 20% to about 80% by weight of FK5-1-12. For the purposes of convenience, fire extinguishants according to this paragraph are sometimes referred to herein as Fire Extinguishant 4.

The present invention also includes fire extinguishants consisting essentially of from about 20% to about 80% by weight of HFO-1233zd(E) and from about 20% to about 80% by weight of FK5-1-12. For the purposes of convenience, fire extinguishants according to this paragraph are sometimes referred to herein as Fire Extinguishant 4A.

The present invention also includes fire extinguishants consisting of from about 20% to about 80% by weight of HFO-1233zd and from about 20% to about 80% by weight of FK5-1-12. For the purposes of convenience, fire extinguishants according to this paragraph are sometimes referred to herein as Fire Extinguishant 5.

The present invention also includes fire extinguishants consisting of from about 20% to about 80% by weight of HFO-1233zd(E) and from about 20% to about 80% by weight of FK5-1-12. For the purposes of convenience, fire extinguishants according to this paragraph are sometimes referred to herein as Fire Extinguishant 5A.

The present invention thus includes fire extinguishants comprising from about 50% to about 80% by weight of HFO-1233zd and from about 20% to about 50% by weight of FK5-1-12, wherein the amount of the HFO-1233zd and FKF-1-12 together preferably comprise at least about 80% by weight of the fire extinguishant. For the purposes of convenience, fire extinguishants according to this paragraph are sometimes referred to herein as Fire Extinguishant 6.

The present invention thus includes fire extinguishants comprising from about 50% to about 80% by weight of HFO-1233zd(E) and from about 20% to about 50% by weight of FK5-1-12, wherein the amount of the HFO-1233zd(E) and FKF-1-12 together preferably comprise at least about 80% by weight of the fire extinguishant. For the purposes of convenience, fire extinguishants according to this paragraph are sometimes referred to herein as Fire Extinguishant 6A.

The present invention also includes fire extinguishants comprising from about 50% to about 80% by weight of HFO-1233zd and from about 20% to about 50% by weight of FK5-1-12, wherein the amount of the HFO-1233zd and FKF-1-12 together preferably comprise at least about 90% by weight of the fire extinguishant. For the purposes of convenience, fire extinguishants according to this paragraph are sometimes referred to herein as Fire Extinguishant 7.

The present invention also includes fire extinguishants comprising from about 50% to about 80% by weight of HFO-1233zd(E) and from about 20% to about 50% by weight of FK5-1-12, wherein the amount of the HFO-1233zd(E) and FKF-1-12 together preferably comprise at least about 90% by weight of the fire extinguishant. For the purposes of convenience, fire extinguishants according to this paragraph are sometimes referred to herein as Fire Extinguishant 7A.

The present invention also includes fire extinguishants comprising from about 50% to about 80% by weight of HFO-1233zd and from about 20% to about 50% by weight of FK5-1-12, wherein the amount of the HFO-1233zd and FKF-1-12 together preferably comprise at least about 95% by weight of the fire extinguishant. For the purposes of convenience, fire extinguishants according to this paragraph are sometimes referred to herein as Fire Extinguishant 8.

The present invention also includes fire extinguishants comprising from about 50% to about 80% by weight of HFO-1233zd(E) and from about 20% to about 50% by weight of FK5-1-12, wherein the amount of the HFO-1233zd(E) and FKF-1-12 together preferably comprise at least about 95% by weight of the fire extinguishant. For the purposes of convenience, fire extinguishants according to this paragraph are sometimes referred to herein as Fire Extinguishant 8A.

The present invention also includes fire extinguishants consisting essentially of from about 50% to about 80% by weight of HFO-1233zd and from about 20% to about 50% by weight of FK5-1-12. For the purposes of convenience, fire extinguishants according to this paragraph are sometimes referred to herein as Fire Extinguishant 9.

The present invention also includes fire extinguishants consisting essentially of from about 50% to about 80% by weight of HFO-1233zd(E) and from about 20% to about 50% by weight of FK5-1-12. For the purposes of convenience, fire extinguishants according to this paragraph are sometimes referred to herein as Fire Extinguishant 9A.

The present invention also includes fire extinguishants consisting of from about 20% to about 80% by weight of HFO-1233zd and from about 20% to about 80% by weight of FK5-1-12. For the purposes of convenience, fire extinguishants according to this paragraph are sometimes referred to herein as Fire Extinguishant 10.

The present invention also includes fire extinguishants consisting of from about 20% to about 80% by weight of HFO-1233zd(E) and from about 20% to about 80% by weight of FK5-1-12. For the purposes of convenience, fire extinguishants according to this paragraph are sometimes referred to herein as Fire Extinguishant 10A.

The present invention also includes fire extinguishants comprising from about 40% to about 60% by weight of HFO-1233zd and from about 40% to about 60% by weight of FK5-1-12. For the purposes of convenience, fire extinguishants according to this paragraph are sometimes referred to herein as Fire Extinguishant 11.

The present invention also includes fire extinguishants comprising of from about 40% to about 60% by weight of HFO-1233zd(E) and from about 40% to about 60% by weight of FK5-1-12. For the purposes of convenience, fire extinguishants according to this paragraph are sometimes referred to herein as Fire Extinguishant 11A.

The present invention also includes fire extinguishants consisting essentially of from about 40% to about 60% by weight of HFO-1233zd and from about 40% to about 60% by weight of FK5-1-12. For the purposes of convenience, fire extinguishants according to this paragraph are sometimes referred to herein as Fire Extinguishant 12.

The present invention also includes fire extinguishants consisting essentially of from about 40% to about 60% by weight of HFO-1233zd(E) and from about 40% to about 60% by weight of FK5-1-12. For the purposes of convenience, fire extinguishants according to this paragraph are sometimes referred to herein as Fire Extinguishant 12A.

The present invention also includes fire extinguishants consisting of from about 40% to about 60% by weight of HFO-1233zd and from about 40% to about 60% by weight of FK5-1-12. For the purposes of convenience, fire extinguishants according to this paragraph are sometimes referred to herein as Fire Extinguishant 13.

The present invention also includes fire extinguishants consisting of from about 40% to about 60% by weight of HFO-1233zd(E) and from about 40% to about 60% by weight of FK5-1-12. For the purposes of convenience, fire extinguishants according to this paragraph are sometimes referred to herein as Fire Extinguishant 13A.

The present invention also includes fire extinguishants comprising about 50% by weight of HFO-1233zd and about 50% by weight of FK5-1-12. For the purposes of convenience, fire extinguishants according to this paragraph are sometimes referred to herein as Fire Extinguishant 14.

The present invention also includes fire extinguishants comprising about 50% by weight of HFO-1233zd(E) and about 50% by weight of FK5-1-12. For the purposes of convenience, fire extinguishants according to this paragraph are sometimes referred to herein as Fire Extinguishant 14A.

The present invention also includes fire extinguishants consisting essentially of about 50% by weight of HFO-1233zd and about 50% by weight of FK5-1-12. For the purposes of convenience, fire extinguishants according to this paragraph are sometimes referred to herein as Fire Extinguishant 15.

The present invention also includes fire extinguishants consisting essentially of about 50% by weight of HFO-1233zd(E) and about 50% by weight of FK5-1-12. For the purposes of convenience, fire extinguishants according to this paragraph are sometimes referred to herein as Fire Extinguishant 15A.

The present invention also includes methods of suppressing a flame comprising bringing a fire extinguishant of the present invention, including any of Fire Extinguishants 1-15, into contact with a flame. As used herein, reference to Fire Extinguishants 1-15 means each of Fire Extinguishants 1, 1A, 2, 2A, 3, 3A, 4, 4A, 5, 5A, 6, 6A, 7, 7A, 8, 8A, 9, 9A, 10, 10A, 11, 11A, 12, 12A, 13, 13A, 14, 14A, 15, and 15A as defined above. The present invention also includes systems for suppressing a flame comprising providing a system to deliver to a potential site of a flame a fire extinguishant of the present invention, including any of Fire Extinguishants 1-15.

DETAILED DESCRIPTION

The term "extinguish" is usually used to denote complete elimination of a fire, whereas, "suppression" is often used to denote reduction, but not necessarily total elimination, of a fire.

For the purposes of the description of the invention herein the term "about" with respect to an amount of an identified component means the amount of the identified component can vary by an amount of +/−1% by weight. The fire extinguishants of the invention include in preferred embodiments amounts of an identified compound or component specified as being "about" wherein the amount is the identified amount +/−0.5% by weight, or +/−0.3% by weight.

The term "about", in relation to temperatures means that the stated temperature can vary by an amount of +/−5° C. In preferred embodiments, temperatures that are identified as "about" include the temperature as specified +/−2° C., or +/−1° C., or +/−0.5° C.

The term "about" in relation to time expressed in seconds means that the stated time can vary by an amount of +/−2 s. In preferred embodiments, times that are identified as "about", preferably include the time as specified +/−1 s, or 0.5 s.

The term "about" in relation to pressure expressed in psi means that the stated pressure can vary by an amount of +/−5 psi. In preferred embodiments, pressures that are identified as "about", preferably include the pressure as specified +/−2 psi, or +/−1 psi, or +/−0.5 psi.

The term HFO-1233zd refers to 1-chloro-3,3,3-trifluoropropene, and therefore, unless otherwise specified, this term encompasses the cis isomer (HFO-1233zd(Z)), the trans isomer (HFO-1233zd(E)), or any combination thereof.

The HFO-1233zd may comprise the unspecified isomer or other impurities, provided that these other components have no material effect on the characteristics of the specified isomer.

Fire Extinguishants

The present invention includes a fire extinguishant comprising 1-chloro-3,3,3-trifluoropropene (HFO-1233zd) and 1,1,1,2,2,4,5,5,5-nonafluoro-4-(trifluoromethyl)-3-pentanone (FK5-1-12).

The HFO-1233zd may consist essentially of trans-HFO-1233zd, or the HFO-1233zd may consist of trans-HFO-1233zd. Alternatively, the HFO-1233zd may consist essentially of cis-HFO-1233zd, or the HFO-1233zd may consist of cis-HFO-1233zd. Preferably, the HFO-1233zd consists essentially of trans-HFO-1233zd, or the HFO-1233zd consists of trans-HFO-1233zd.

It will be appreciated that the fire extinguishant may comprise the HFO-1233zd and FK5-1-12 in widely ranging amounts within the broad teachings of the present specification and those skilled in the art will be able to use the teachings contained herein select a particular ratio to best meet any particular need. For example, the fire extinguishant may comprise at least about 5% by weight, preferably at least about 7% by weight, more preferably at least about 10% by weight of FK5-1-12.

For example, the FK5-1-12 may be present in the fire extinguishant in an amount of from about 5% to about 95% by weight, or in an amount of from about 10% to about 90% by weight, or in an amount of from about 20% to about 80% by weight, in an amount of from about 30% to about 70% by weight, or in an amount of from about 40% to about 60% by weight, or in an amount of from about 45% to about 55% by weight.

The fire extinguishant may comprise HFO-1233zd in an amount of from about 5% to about 95% by weight, or in an amount of from about 10% to about 90% by weight, or in an amount of from about 20% to about 80% by weight, in an amount of from about 30% to about 70% by weight, or in an amount of from about 40% to about 60% by weight, or in an amount of from about 45% to about 55% by weight. The fire extinguishant may consists essentially of HFO-1233zd and FK5-1-12, or the fire extinguishant may consists of HFO-1233zd and FK5-1-12.

Thus, the present disclosure includes a fire extinguishant consisting essentially of HFO-1233zd and FK5-1-12, wherein the FK5-1-12 is present in an amount of at least about 5% by weight, preferably in an amount of at least about 7% by weight, more preferably in an amount of at least about 10% by weight of the fire extinguishant. The HFO-1233zd may consist essentially of trans-HFO-1233zd, or may consist essentially of cis-HFO-1233zd. Preferably, the HFO-1233zd consists essentially of trans-HFO-1233zd.

The present disclosure also provides a fire extinguishant consisting essentially of HFO-1233zd and FK5-1-12, wherein the FK5-1-12 is present in an amount of from about 5% to about 95% by weight, or in an amount of from about 10% to about 90% by weight, or in an amount of from about 20% to about 80% by weight, in an amount of from about 30% to about 70% by weight, or in an amount of from about 40% to about 60% by weight, or in an amount of from about 45% to about 55% by weight of the fire extinguishant. The HFO-1233zd may consist essentially of trans-HFO-1233zd, or may consist essentially of cis-HFO-1233zd. Preferably, the HFO-1233zd consists essentially of trans-HFO-1233zd.

Applicants have found that a highly desirable and unexpected combination of properties can be achieved by using fire extinguishants of the present invention having amounts of HFO-1233zd and FK5-1-12 as described herein, including particularly Fire Extinguishants 1-15. In preferred embodiments as described in Fire Extinguishants 1-15, for example, the relative proportions of the specified components enable a fire extinguishing agent which has excellent and rapid fire extinguishing properties and at the same time is deliverable to about atmospheric pressure conditions at least predominantly as a vapor, and even more preferably substantially completely as a vapor.

The present invention includes fire extinguishants that may comprise, in addition to the HFO-1233zd and FK5-1-12, one or more further compounds. For example, the fire extinguishant may comprise other components in minor proportion, for example, in amounts less than about 20%, or less than about 5% by weight, or less than about 2% by weight, or less than about 1% by weight, and preferably these other components do not negate the novel and basic the characteristics of the fire extinguishant. The one or more further compounds may be selected in preferred embodiments from the group consisting of HFC-245fa, HCFC-22, HFC-23, HCFC-123, HCFC-123a, HCFC-123b, HCFC-124, HCFC-124a, HFC-125, HFC-134, HCFC-134a, HCFC-132, HFC-227ea, HFC-227ca, HFC-236fa, HFC-236ea, HFC-236cb, HFC-245ea, HFC-245eb, HFC-245cb and $CF_3I$.

For example, the fire extinguishant may comprise HFO-1233zd, FK5-1-12 and one or more further compounds may be selected from the group consisting of HFC-245fa, HCFC-22, HFC-23, HCFC-123, HCFC-123a, HCFC-123b, HCFC-124, HCFC-124a, HFC-125, HFC-134, HCFC-134a, HCFC-132, HFC-227ea, HFC-227ca, HFC-236fa, HFC-236ea, HFC-236cb, HFC-245ea, HFC-245eb, HFC-245cb and $CF_3I$, wherein the HFO-1233zd is present in an amount of from about 5% to about 95% by weight, or in an amount of from about 10% to about 90% by weight, or in an amount of from about 20% to about 80% by weight, in an amount of from about 30% to about 70% by weight, or in an amount of from about 40% to about 60% by weight, or in an amount of from about 45% to about 55% by weight of the fire extinguishant, and/or wherein the FK5-1-12 is present in an amount of from about 5% to about 95% by weight, or in an amount of from about 10% to about 90% by weight, or in an amount of from about 20% to about 80% by weight, in an amount of from about 30% to about 70% by weight, or in an amount of from about 40% to about 60% by weight, or in an amount of from about 45% to about 55% by weight of the fire extinguishant, preferably wherein in each of such cases the HFO-1233zd and the FK5-1-12 together comprise at least about 80% of the fire suppressant.

The fire extinguishant may have a Global Warming Potential (GWP) of not greater than about 500, preferably not greater than about 300, more preferably not greater than about 150. Preferably, the composition has a GWP of not greater than about 150.

The fire extinguishant may have an Ozone Depletion Potential of not greater than about 0.02, preferably not greater than about 0.01.

Boiling Point

The fire extinguishants of the present invention, including any of Fire Extinguishants 1-10, herein may have a boiling point of less than about 40° C., preferably less than about 40° C., or less than about 35° C., or less than about 30° C., or less than about 25° C. at about atmospheric pressure (.e. at about 1 atm). If the fire extinguishant boils at about constant atmospheric pressure over a range of temperatures, then the term "boiling point" refers to the mid point of the dew and bubble temperatures of the composition.

Fire Extinguishment Speed

The preferred fire extinguishants of the present invention, including Fire Extinguishants 1-15, unexpectedly have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 6 volume % in air.

The fire extinguishants, including Fire Extinguishants 1-15, and methods of the present invention unexpectedly have the ability to produce a fire extinguishment speed (as measured in accordance with the procedures described herein, including in the Examples) of about 20 seconds or less for test temperatures of about 100° F. and relative humidities of about 90% or less when present in a concentration of not greater than about 6 volume % in air.

The fire extinguishants, including Fire Extinguishants 1-15, and methods of the present invention unexpectedly have the ability to produce a fire extinguishment speed (as measured in accordance with the procedures described herein, including in the Examples) of about 15 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 40° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 30° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 25° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 40° C. and (ii) have the ability to produce a fire extinguishment speed (as measured in accordance with the procedures described herein, including in the Examples) of about 20 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 30° C. and (ii) have the ability to produce a fire extinguishment speed (as measured in accordance with the procedures described herein, including in the Examples) of about 20 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 25° C. and (ii) have the ability to produce a fire extinguishment speed (as measured in accordance with the procedures described herein, including in the Examples) of about 20 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 40° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 30° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 25° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 40° C. and (ii) have the ability to produce a fire extinguishment speed (as measured in accordance with the procedures described herein, including in the Examples) of about 15 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 30° C. and (ii) have the ability to produce a fire extinguishment speed (as measured in accordance with the procedures described herein, including in the Examples) of about 15 seconds or less for test temperatures of about 100° F. and relative humidities of about 90% or less when present in a concentration of not greater than about 6 volume % in air.

The present invention includes any of the Fire Extinguishants of the present invention, including Fire Extinguishants 1-15, which (i) have a boiling point of less than about 25° C. and (ii) have the ability to produce a fire extinguishment speed (as measured in accordance with the procedures described herein, including in the Examples) of about 15 seconds or less for test temperatures of about 100° F. and relative humidities of about 90% or less when present in a concentration of not greater than about 6 volume % in air.

The preferred fire extinguishants of the present invention, including Fire Extinguishants 1-15, unexpectedly have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 5 volume % in air.

The fire extinguishants, including Fire Extinguishants 1-15, and methods of the present invention unexpectedly have the ability to produce a fire extinguishment speed (as measured in accordance with the procedures described herein, including in the Examples) of about 20 seconds or less for test temperatures of about 100° F. and relative humidities of about 90% or less when present in a concentration of not greater than about 5 volume % in air.

The fire extinguishants, including Fire Extinguishants 1-15, and methods of the present invention unexpectedly have the ability to produce a fire extinguishment speed (as measured in accordance with the procedures described herein, including in the Examples) of about 15 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 40° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 30° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 25° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 40° C. and (ii) have the ability to produce a fire extinguishment speed (as measured in accordance with the procedures described herein, including in the Examples) of about 20 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 30° C. and (ii) have the ability to produce a fire extinguishment speed (as measured in accordance with the procedures described herein, including in the Examples) of about 20 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 25° C. and (ii) have the ability to produce a fire extinguishment speed (as measured in accordance with the procedures described herein, including in the Examples) of about 20 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 40° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 30° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 25° C. and (ii) have the ability to produce a fire extinguishment speed (as measured in accordance with the procedures described herein, including in the Examples) of about 30 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 40° C. and (ii) have the ability to produce a fire extinguishment speed (as measured in accordance with the procedures described herein, including in the Examples) of about 15 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 30° C. and (ii) have the ability to produce a fire extinguishment speed (as measured in accordance with the procedures described herein, including in the Examples) of about 15 seconds or less for test temperatures of about 100° F. and relative humidities of about 90% or less when present in a concentration of not greater than about 5 volume % in air.

The present invention includes any of the Fire Extinguishants of the present invention, including Fire Extinguishants 1-15, which (i) have a boiling point of less than about 25° C. and (ii) have the ability to produce a fire extinguishment speed (as measured in accordance with the procedures described herein, including in the Examples) of about 15 seconds or less for test temperatures of about 100° F. and relative humidities of about 90% or less when present in a concentration of not greater than about 5 volume % in air.

Compositions

The present disclosure provides a composition which comprises any of the fire extinguishants according to the present invention, including any of Fire Extinguishants 1-15.

The composition may comprise at least about 70% by weight, preferably at least about 90% by weight, more preferably at least about 95% by weight of the fire extinguishant of the present invention, including including any of Fire Extinguishants 1-15.

The composition may comprise a propellant. The propellant may be used to propel the extinguishant from a container in which it is stored to the location of the fire to be extinguished. Preferably, the propellant is selected from the group consisting of argon (Ar), nitrogen ($N_2$), helium (He), carbon dioxide ($CO_2$), and combinations thereof. More preferably, the propellant is selected from Ar and $N_2$.

The composition may comprise one or more detoxifying agents. The detoxifying agent may be present in the composition in an amount of from about 0.1% to about 10% by weight. The one or more detoxifying agents may be selected from the group consisting of citral, limonene, terpinene, sabinene, ocimene, beta-pinene, phytol, squalene, oleanolic, lutein, oleic acid, eleostearic acid, palmitoleic acid, citronnellal, dipentene, terpinolene, menthadiene, myrcene, turpentine, vitamin A, lanosterol, lycopene, alpha-terpineol, linoleic acid, lincanic acid, petroselenic acid, citronellol, menthol, sylvestrene, zingiberene, alpha-pinene, camphor, abietic acid, saponin, beta-carotene, para-cymeme, linolenic acid, ricinoleic acid, vaccenic acid and combinations thereof, preferably the one or more detoxifying agents is limonene.

The composition may consist essentially of the fire extinguishant, the propellant and optionally the one or more detoxifying agents as defined above.

Methods and Systems

The present disclosure provides a method of extinguishing a flame, or a method of suppressing a flame. The method comprises the step of contacting a flame with a fire extinguishant of the present invention, including any of the Fire Extinguishants 1-15.

Alternatively, the method comprises the step of contacting a flame with a composition comprising a fire extinguishant of the present invention, including any of the Fire Extinguishants 1-15. The composition may comprise at least about 70% by weight, preferably at least about 90% by weight, more preferably at least about 95% by weight of a fire extinguishant of the present invention, including any of the Fire Extinguishants 1-15.

The composition may comprise a propellant. The propellant may be used to propel the extinguishant from a container in which it is stored to the location of the fire to be extinguished. Preferably, the propellant is selected from the group consisting of argon (Ar), nitrogen ($N_2$), helium (He), carbon dioxide ($CO_2$), and combinations thereof. More preferably, the propellant is selected from Ar and $N_2$.

The composition may comprise one or more detoxifying agents. The detoxifying agent may be present in the composition in an amount of from about 0.1% to about 10% by weight. The one or more detoxifying agents may be selected from the group consisting of citral, limonene, terpinene, sabinene, ocimene, beta-pinene, phytol, squalene, oleanolic, lutein, oleic acid, eleostearic acid, palmitoleic acid, citronnellal, dipentene, terpinolene, menthadiene, myrcene, turpentine, vitamin A, lanosterol, lycopene, alpha-terpineol, linoleic acid, lincanic acid, petroselenic acid, citronellol, menthol, sylvestrene, zingiberene, alpha-pinene, camphor, abietic acid, saponin, beta-carotene, para-cymeme, linolenic acid, ricinoleic acid, vaccenic acid and combinations thereof, preferably the one or more detoxifying agents is limonene.

The composition may consist essentially of afire extinguishant of the present invention, including any of the Fire Extinguishants 1-15, the propellant and optionally the one or more detoxifying agents as defined above.

It will be appreciated that a fire extinguishant of the present invention, including any of the Fire Extinguishants 1-15 or composition comprising afire extinguishant of the present invention, including any of the Fire Extinguishants 1-15, may be sprayed or poured onto the flame. Alternatively, at least a portion of the flame may be immersed in a fire extinguishant of the present invention, including any of the Fire Extinguishants 1-15 or composition comprising a fire extinguishant of the present invention, including any of the Fire Extinguishants 1-15.

Fire extinguishant of the invention, including any of the Fire Extinguishants 1-15, can be used in total flooding applications, and in streaming applications.

Total Flooding Applications

The disclosure provides a method for extinguishing a flame in a total flooding application. Total flooding applications can either be used to extinguish a flame in an enclosed area, or to inert an enclosed area thereby preventing a flame from propagating. In a total flooding application, the fire extinguishant of the present invention, including any of the Fire Extinguishants 1-15, is discharged into an enclosed area. The fire extinguishant then disperses, evaporating if it is initially a liquid, to form a mixture of air and gaseous fire extinguishant. Successful fire extinguishing occurs when the fire extinguishant exceeds the minimum extinguishing concentration (MEC), thereby causing flame extinguishment. However, it is desirable to avoid using excessive quantities of fire extinguishant to prevent the creation of an air/fire extinguishant atmosphere which is harmful to people due to hypoxia, fire extinguishant toxicity, or both. It is also desirable that effective and rapid fire extinguishment be achieved at low cost, which tends in general to be benefited by fire extinguishants that have low MEC values and by fire extinguishants that result in little or no damage to the area being treated and/or the articles in the area being treated and/or with little or no need to remove expended liquid fire extinguishant form the area once the fire has been extinguished. The fire extinguishants of the present invention, including Fire Extinguishants 1-15, and the preferred methods and systems of the present invention, including those which use Fire Extinguishants 1-15, are surprising able to achieve this difficult-to-achieve combination of properties and performance advantages.

There is provided a method for extinguishing a flame in an enclosed area, the method comprising the steps of:

Optionally detecting the flame in the enclosed area; and

Discharging a fire extinguishant of the present invention, including any of the Fire Extinguishants 1-15, or a composition comprising a fire extinguishant of the present invention, including any of the Fire Extinguishants 1-15, into the enclosed area, thereby extinguishing the flame.

The fire extinguishant of the present invention, including any of the Fire Extinguishants 1-15, may be discharged into the enclosed area in an amount sufficient to extinguish the flame. Preferably, the flame is extinguished within about 60 seconds as measure from the time the fire extinguishant has been first discharged into the enclosed area, more preferably within about 30 seconds, and more preferably within about 20 seconds. Preferably, the extinguishant is discharged within about 20 seconds, more preferably within about 10 seconds.

The present methods include introducing the fire extinguishant of the present invention, including any of the Fire Extinguishants 1-15, into the an enclosed area wherein the temperature in the enclosed area is at least about 15° C. (59° F.), at least about 20° C. (68° F.), at least about 25° C. (77° F.), or at least about 30° C. (86° F.), or at least about 38° C. (100° F.).

The present methods include introducing the fire extinguishant of the present invention, including any of the Fire Extinguishants 1-15, into an enclosed area with a relative humidity (RH) of at least about 20%, or at least about 35%, or at least about 50%, or at least about 65%, or at least about 80%.

The present methods include introducing the fire extinguishant of the present invention, including any of the Fire Extinguishants 1-15, into the an enclosed area wherein (i) the temperature in the enclosed area is at least about 25° C. (77° F.) and (ii) relative humidity (RH) within the enclosed area is at least about 50%.

The present methods include introducing the fire extinguishant of the present invention, including any of the Fire Extinguishants 1-15, into the an enclosed area wherein (i) the the temperature in the enclosed area is at least about 30° C. (86° F.), and (ii) relative humidity (RH) within the enclosed area is at least about 50%.

The present methods include introducing the fire extinguishant of the present invention, including any of the Fire Extinguishants 1-15, into the an enclosed area wherein (i) the the temperature in the enclosed area is at least about 30° C. (86° F.), and (ii) relative humidity (RH) within the enclosed area is at least about 65%.

The present methods include introducing the fire extinguishant of the present invention, including any of the Fire Extinguishants 1-15, into the an enclosed area wherein (i) the the temperature in the enclosed area is at least about 30° C. (86° F.), and (ii) relative humidity (RH) within the enclosed area is at least about 80%.

The present disclosure also provides a method of preventing a fire in an enclosed area (i.e. a method of inerting). Thus, there is provided a method of preventing a fire, the method comprising the step of discharging a fire extinguishant of the present invention, including any of the Fire Extinguishants 1-15, or a composition comprising the fire extinguishant of the present invention, including any of the Fire Extinguishants 1-15, into the enclosed area. For inerting methods the fire extinguishant may be any of the fire extinguishants of the present invention, including any of the Fire Extinguishants 1-15. The fire extinguishant of the present invention, including any of the Fire Extinguishants 1-15, may be discharged in such inerting methods into the enclosed area in an amount sufficient to prevent a flame from propagating. Preferably, the flame is extinguished within about 60 seconds, more preferably within about 30 seconds of the fire extinguishant first being discharged into the enclosed area. Preferably, the extinguishant is discharged within about 20 seconds, more preferably within about 10 seconds. The temperature within the enclosed area may be at least about 15° C., at least about 20° C., at least about 25° C., or at least about 30° C. The relative humidity (RH) within the enclosed area may be at least about 20%, preferably of at least about 35%, preferably of at least about 50%, more preferably of at least about 65%, more preferably of at least about 80%.

The enclosed area for either the method of extinguishing the flame, or the method of inerting, may be part (or the entirety) of a building or structure, a watercraft vessel, a motor or rail vehicle, a spacecraft or an aircraft. The term "building or structure" encompasses both permanent and semi-permanent buildings or structures, and may be a residential, commercial or industrial building or structure. For example, the enclosed area may be a vault; a computer room (e.g. a computer server room); an aircraft cabin or cockpit; an engine compartment of a watercraft vessel, motor vehicle, rail vehicle, spacecraft or aircraft; a museum; a library a document archive; a petroleum pipeline pumping station; an aircraft or water vessel cargo bay, etc.

Thus, the above methods may be used to protect an item of value, an item which is susceptible to water damage, or a flammable material (e.g. a container containing a flammable gas or liquid), which is contained within the enclosed area from fire.

The disclosure provides a total flooding system. The total flooding system comprises an enclosed area(s) (1), one or more container(s) (2) comprising a fire extinguishant of the present invention, including any of the Fire Extinguishants 1-15, a distribution piping network (3), and an orifice (such as a nozzle or sprinkler) (4) for delivering the fire extinguishant from the distribution piping network (3) to the enclosed area(s) (1). The system may optionally comprise one or more detector(s) (5) for detecting a fire in the enclosed area(s) (1). The system may also comprise a detection control system (6) and/or an alarm (7). The detection control system (6) may be in communication with the one or more container(s) (2), such that when a fire is detected, the detection control system (6) causes the fire extinguishant to be released from the one or more container(s) (2).

In such total flooding systems, the fire extinguishants of the present invention may be used, including any of the Fire Extinguishants 1-15. The container may comprise the fire extinguishant of the present invention may be used, including any of the Fire Extinguishants 1-15 in an amount of at least about 70% by weight, preferably at least about 90% by weight, more preferably at least about 95% by weight.

The container may additionally comprise a propellant. The propellant may be used to propel the extinguishant from the container. Preferably, the propellant is selected from the group consisting of argon (Ar), nitrogen ($N_2$), helium (He), carbon dioxide ($CO_2$), and combinations thereof. More preferably, the propellant is selected from Ar and $N_2$.

The container may be pressurized to a pressure of from about 80 to about 800 psi at 21° C.

The container may alternatively or additionally comprise one or more detoxifying agents. The detoxifying agent may be present in the container in an amount of from about 0.1% to about 10% by weight. The one or more detoxifying agents may be selected from the group consisting of citral, limonene, terpinene, sabinene, ocimene, beta-pinene, phytol, squalene, oleanolic, lutein, oleic acid, eleostearic acid, palmitoleic acid, citronnellal, dipentene, terpinolene, menthadiene, myrcene, turpentine, vitamin A, lanosterol, lycopene, alpha-terpineol, linoleic acid, lincanic acid, petroselenic acid, citronellol, menthol, sylvestrene, zingiberene, alpha-pinene, camphor, abietic acid, saponin, beta-carotene, para-cymeme, linolenic acid, ricinoleic acid, vaccenic acid and combinations thereof, preferably the one or more detoxifying agents is limonene.

Streaming Applications

The present disclosure also provides a method for extinguishing a flame using a streaming application.

Thus, the disclosure relates to a method for suppressing or extinguishing a flame in a streaming application, the method comprising the steps of:

Transporting a container comprising a fire extinguishant disclosed herein, or a composition comprising a fire extinguishant disclosed herein, to the vicinity of the flame, wherein said container is capable of discharging the fire extinguishant or composition; and Discharging the fire extinguishant or composition into an area surrounding the flame thereby suppressing or extinguishing the flame.

For streaming applications any fire extinguishant of the present invention may be used, including any of the Fire Extinguishants 1-15, or compositions comprising any fire extinguishant of the present invention may be used, including any of the Fire Extinguishants 1-15. The composition may comprise at least about 70% by weight, preferably at least about 90% by weight, more preferably at least about 95% by weight of the fire extinguishant of the invention.

The composition may comprise a propellant. The propellant may be used to propel the extinguishant from a container in which it is stored to the location of the fire to be extinguished. Preferably, the propellant is selected from the group consisting of argon (Ar), nitrogen ($N_2$), helium (He), carbon dioxide ($CO_2$), and combinations thereof. More preferably, the propellant is selected from Ar and $N_2$.

The composition may comprise one or more detoxifying agents. The detoxifying agent may be present in the composition in an amount of from about 0.1% to about 10% by weight. The one or more detoxifying agents may be selected from the group consisting of citral, limonene, terpinene, sabinene, ocimene, beta-pinene, phytol, squalene, oleanolic, lutein, oleic acid, eleostearic acid, palmitoleic acid, citronnellal, dipentene, terpinolene, menthadiene, myrcene, turpentine, vitamin A, lanosterol, lycopene, alpha-terpineol, linoleic acid, lincanic acid, petroselenic acid, citronellol, menthol, sylvestrene, zingiberene, alpha-pinene, camphor, abietic acid, saponin, beta-carotene, para-cymeme, linolenic acid, ricinoleic acid, vaccenic acid and combinations thereof, preferably the one or more detoxifying agents is limonene.

The composition may consist essentially of the fire extinguishant, the propellant and optionally the one or more detoxifying agents as defined above.

The present disclosure also provides a container comprising a fire extinguishant disclosed herein. The fire extinguishant may be any of the fire extinguishants described herein. The container is configured to discharge the fire extinguishant. The fire extinguishant may be sprayed or poured into the area surrounding the flame.

The fire extinguishant may be discharged manually, or it may be discharged automatically from the container. For example, the cylinder may contain a valve assembly which, when actuated, releases the fire extinguishant, or the composition comprising the fire extinguishant, from the cylinder.

The container may comprise at least about 70% by weight, preferably at least about 90% by weight, more preferably at least about 95% by weight of the fire extinguishant.

The container may comprise a propellant. The propellant may be used to propel the extinguishant from the container to the location of the fire to be extinguished. Preferably, the propellant is selected from the group consisting of argon (Ar), nitrogen ($N_2$), helium (He), carbon dioxide ($CO_2$), and combinations thereof. More preferably, the propellant is selected from Ar and $N_2$.

The container may be pressurized to a pressure of from about 80 to about 800 psi at 21° C.

The container may comprise one or more detoxifying agents. The detoxifying agent may be present in the container in an amount of from about 0.1% to about 10% by weight. The one or more detoxifying agents may be selected from the group consisting of citral, limonene, terpinene, sabinene, ocimene, beta-pinene, phytol, squalene, oleanolic, lutein, oleic acid, eleostearic acid, palmitoleic acid, citronnellal, dipentene, terpinolene, menthadiene, myrcene, turpentine, vitamin A, lanosterol, lycopene, alpha-terpineol, linoleic acid, lincanic acid, petroselenic acid, citronellol, menthol, sylvestrene, zingiberene, alpha-pinene, camphor, abietic acid, saponin, beta-carotene, para-cymeme, linolenic acid, ricinoleic acid, vaccenic acid and combinations thereof, preferably the one or more detoxifying agents is limonene.

The container may consist essentially of the fire extinguishant, the propellant and optionally the one or more detoxifying agents as defined above.

The container may be a handheld extinguisher.

Tests

The Minimum Extinguishing Concentration (MEC) can be determined using the cup burner method as set out in Annex B of NFPA-2001, 2015 Edition, for extinguishing a Class B test fire.

It will be appreciated that many national and international standards will set a Minimum Design Concentration (MDC), which is equal to the MEC, multiplied by a small excess (e.g. multiplied by 1.3), thereby resulting in a concentration having a safety margin factored into this amount.

The ability of the fire extinguishants disclosed herein to function effectively at high temperatures (e.g. at temperatures at or above about 25° C., or at or above about 30° C.), and/or high humidity (e.g. at a relative humidity of at least about 20%, preferably of at least about 35%, preferably of at least about 50%, more preferably of at least about 65%, more preferably of at least about 80%) can be determined using the following method, referred to herein as the "closed drum test".

Apparatus

1 Drum, open-head, 55 gal (208 $d^3$), modified as folllows:

1.1 Fit a closure over the open drum head. The closure may be either a hinged lid (FIG. 2), or a ½-mil (0.0127-mm) thickness of polyamide film. If the film is used, apply it as follows:

1.1.1 Stretch the film over the open end of the drum and hold it in place by a strong rubber band, that will stretch 1 in. (25 mm) when a 1-lb (0.45-kg) mass is hung from its lowest point when around the drum.

1.1.2 Cut a 1-in. (25-mm) vertical slit in the film, beginning at a point 2 in. (51 mm) from the top of the drum.

1.1.3 Draw the film taut over the opening.

1.2 Bore a circular opening 1 in. (25 mm) in diameter through the base, about 2 in. (51 mm) from the edge, in such a position that when the drum is on its side the hole will be at the top.

1.3 A metal base 4 in. (102 mm) long, 4 in. (102 mm) wide, and at least 1/16 in. (1.6 mm) thick upon which a pipe having an internal diameter of 3 in (76 mm) and a length of 4 in. (102 mm) is welded.

1.4 Optionally, a 6-in. (152-mm) square opening may be cut through the centre of the drum base and securely covered with a piece of safety glass.

Method 2.1 A container is charged with the fire extinguishant and nitrogen gas to a pressure of 125 psi. The container has a short length of tubing with an internal diameter of 1/8 in. (3.2 mm) is attached to the container through which the extinguishant can be released.

2.2 Lay the drum on its side (FIG. 2), and adjust the temperature of the room in which the drum is contained to the desired level.

2.3 Ensure that the centre of the plate on which the pipe is welded is positioned half-way from each end of the drum.

2.4 Add 1 in. (25 mm) of water and 25 ml of n-heptane with a minimum purity of 99% to the cup created by the pipe welded to the metal base.

2.5 Place a hot plate in the drum, and then place a beaker of boiling water on the hot plate. Boil the water to provide the desired humidity. The relative humidity is measured using a probe, and the absolute humidity is calculated from this value.

2.6 Immediately light the fuel in the pipe and secure the closure. (If the film closure is used, ignite the fuel by means of a taper through the 1-in. (25-mm) circular opening.)

2.7 Shake the container and hold it upright or, if necessary, in such a position that the liquid contents can be sprayed directly into the drum. The container is configured to release the full charge into the drum 2.8 As quickly as possible, place the dispenser at the 1-in. (25-mm) opening and spray directly into the drum, directing the spray toward the centre of the opposite end, until the fire is extinguished, or for a period up to 120 s, whichever occurs first. The time period measure (as reported in the tables below) begins when the extinguishant is first released into the drum and ends at the extinguishment of the fire or as otherwise reported in the table.

2.9 After each test, open the drum to clear the atmosphere, and clean the drum of any residues which might affect future tests.

DESCRIPTION OF THE FIGURES

FIG. 1 sets out an exemplary total flooding system using a fire extinguishant of the invention.

The fire extinguishant may be stored externally to an enclosed area(s) (1) in one or more container(s) (2). The one or more container(s) (2) is connected to a distribution piping network (3), which allows the fire extinguishant to be delivered to the enclosed area(s) (1). The fire extinguishant may be delivered from the distribution piping network (3) to the enclosed area(s) (1) through a nozzle or sprinkler (4).

The total flooding system may additionally comprise one or more detectors (5) for detecting a fire in the enclosed area(s) (1).

The total flooding system may also comprise a detection control system (6) and/or an alarm (7). The detection control system (6) may be in communication with the one or more container(s) (2), such that when a fire is detected, the detection control system (6) causes the fire extinguishant to be released from the one or more container(s) (2).

The container (2) may additionally comprise a propellant. The propellant may be selected from the group consisting of Ar, $N_2$, He, $CO_2$, and combinations thereof. The propellant may be used to pressurize the container. The container (2) may be pressurized to a pressure of from about 80 to about 800 psi at 21° C.

For example, if a fire is present in the enclosed area(s) (1), or the enclosed area(s) (1) is to be inerted, the fire extinguishant of the invention may be discharged from the one or more container(s) (2) into the distribution piping network (3). The fire extinguishant then travels through the distribution piping network (3), and is then delivered to the enclosed area(s) (1) through a nozzle or sprinkler (4).

FIG. 2 is a schematic of a closed drum which may be used in the "closed drum test" described herein.

EXAMPLES

Example 1

The Minimum Extinguishing Concentration (MEC) of HFO-1233zd(E) was determined using the cup burner method as set out in Annex B of NFPA-2001, 2015 Edition, for extinguishing a Class B test fire. An air flow rate of 40 liter/min was used.

The fuel was commercial grade n-heptane (initial boiling point of a minimum of 90° C., maximum dry point of 100° C., and specific gravity of 0.69-0.73). The HFO-1233zd(E) had a purity of >99.8%.

Tests were conducted at ambient laboratory temperature (23° C.±2° C.), and the fuel in the cup was brought to ambient laboratory temperature (23° C.±2° C.).

The MEC of the HFO-1233zd(E) was determined to be 6.5 vol % in air.

Example 2

Applicants have conducted experiments to evaluate the ability of various mixtures of HFO-1233zd(E) and FK5-1-12 to be discharged into potential spaces that may need flame extinguishing or inerting substantially in the form of a vapor at atmospheric pressure. Based on this experimental work, it has been determined that mixtures of HFO-1233zd(E) and FK5-1-12 in which at least about 20% of the mixture is HFO-1233zd(E) are required to ensure that the fire extinguishant is introduced to and/or present in the space once dispensed substantially only as a vapor. In particular and preferred embodiments, the boiling point of the mixture is not greater than about 25 C, which acts to minimize the amount of liquid that is introduced to and/or is present in the space once dispensed, and applicants have found that that mixtures consisting of HFO-1233zd(E) and FK5-1-12 in which at least about 20% of the mixture is HFO-1233zd(E) achieve this result.

Example 3

The "closed drum test" set out above was used to test various lends of HFO-1233zd(E) and FK5-1-12 for fire suppression performance. The fire was a 1.6 kW fire. The results are set out in Table 1 below.

TABLE 1 results of closed drum test

| No. | 1233zd (E) (Wt %/ (g)) | FK5-1-12 (Wt %/ (g)) | Conc. (Vol % in air) | Temp. (° F.) | Absolute humidity (g $H_2O$/ kg dry air) | Relative Humidity, RH (%) | Time to extinguish (s) | Comments |
|---|---|---|---|---|---|---|---|---|
| 1 | 100.00 (95.0) | — | 7.8 | 103.0 | 24.56 | 53 | — | Deflagration (during release) |
| 2 | 100.00 (95.0) | — | 7.8 | 67.0 | 6.8 | 48 | 25 | Fire extinguished |
| 3 | 100.00 (95.0) | — | 7.8 | 93.0 | 5.31 | 16 | 30 | Fire extinguished (door cracked open) |
| 4 | 100.00 (95.0) | — | 7.8 | 91.0 | 3.73 | 12 | 32 | Fire extinguished (not within 30 s) |
| 5 | 100.00 (95.0) | — | 7.8 | 96.6 | 24.45 | 64 | 30 | Deflagration |
| 6 | 94.74 (90.0) | 5.26 (5.0) | 7.6 | 93.0 | 30.02 | 87 | 120+ | Fire not extinguished |
| 7 | 89.95 (85.0) | 10.05 (9.5) | 7.3 | 101.1 | 32.35 | 73 | 50 | Fire extinguished (not within 30 s) |
| 8 | 89.47 (85.0) | 10.53 (10.0) | 7.3 | 97.0 | 35.4 | 95 | 96 | Fire extinguished (not within 30 s) |
| 9 | 89.47 (67.1) | 10.53 (7.9) | 5.9 | 85.5 | 20.68 | 77 | 70 | Fire extinguished (not within 30 s) |
| 10 | 78.95 (60.0) | 21.05 (16.0) | 5.6 | 89.2 | 23.98 | 79 | 15 | Fire extinguished |
| 11 | 78.91 (86.8) | 21.09 (23.2) | 7.9 | 99.1 | 29.5 | 71 | 10.5 | Fire extinguished |
| 12 | 50.00 (49.1) | 50.00 (49.1) | 5.8 | 88.0 | 25.8 | 88 | 15.5 | Fire extinguished |
| 13 | 50.00 (67.7) | 50.00 (67.7) | 7.8 | 88.3 | 25.4 | 86 | 13 | Fire extinguished |
| 14 | 50.00 (109.1) | 50.00 (109.1) | 12.0 | 88.0 | 25.5 | 87 | 10 | Fire extinguished |
| 15 | — | 100.00 (98.0) | 3.5 | 100.2 | 38.3 | 88 | 10 | Fire extinguished |
| 16 | — | 100.00 (128.0) | 4.5 | 90.1 | 27.6 | 88 | 11 | Fire extinguished |
| 17 | — | 100.00 (169.0) | 5.8 | 88.0 | 24.6 | 84 | 8 | Fire extinguished |

As can be seen from applicants test work as reported in Examples 2 and Example 3, applicants have unexpectedly found that it is possible to achieve fire extinguishants of the present invention, including Fire Extinguishants 1-15, that are able to effectively and quickly suppress a flame, with relatively low air volume concentrations, and at the same time be vaporous as introduced and/or as present in the space, particularly when the compositions comprise, consist essentially of, or consist of from greater than about 20% by weight of HFO-1233zd(E) (less than about 80% by weight of FK5-1-12) and less than about 80% of HFO-1233zd (greater than about 20% by weight of FK5-1-12), more preferably from greater than about 40% by weight of HFO-1233zd(E) (less than about 60% by weight of FK5-1-12) and less than about 60% of HFO-1233zd (greater than about 40% by weight of FK5-1-12), and even more preferably about 50% by weight of HFO-1233zd(E) and about 50% by weight of FK5-1-12). The results in Table 1 demonstrate that the preferred fire extinguishants of the present invention, including Fire Extinguishants 1-15, can effectively function as a fire extinguishant not only under standard temperatures and humidities, but that they perform especially well at increased temperature and humidity conditions in the area being extinguished or inerted.

The invention claimed is:

1. A fire extinguishant comprising from about 20% to about 80% by weight of trans-1-chloro-3,3,3-trifluoropropene (transHFO-1233zd) and from about 20% to about 80% by weight of 1,1,1,2,2,4,5,5,5-nonafluoro-4-(trifluoromethyl)-3-pentanone (FK5-1-12), wherein the amount of the transHFO-1233zd and and FKF-1-12 together comprise at least about 80% by weight of the fire extinguishant.

2. The fire extinguishant of claim 1, wherein the transHFO-1233zd and FK5-1-12 together comprise at least about 90% by weight of the fire extinguishant.

3. The fire extinguishant of claim 1, consisting essentially of transHFO-1233zd and FK5-1-12.

4. The fire extinguishant of claim 1 comprising from about 50% to about 80% by weight of transHFO-1233zd and from about 20% to about 50% by weight of FK5-1-12.

5. The fire extinguishant of claim 1 comprising from about 40% to about 60% by weight of transHFO-1233zd and from about 40% to about 60% by weight of FK5-1-12.

6. The fire extinguishant of claim 5, wherein the transHFO-1233zd and FK5-1-12 together comprise at least about 90% by weight of the fire extinguishant.

7. The fire extinguishant of claim 6 comprising about 50% by weight of transHFO-1233zd and about 50% by weight of FK5-1-12.

8. A method of extinguishing a flame comprising:

(a) providing a fire extinguishant comprising from about 20% to about 80% by weight of trans-1-chloro-3,3,3-trifluoropropene (transHFO-1233zd) and from about 20% to about 80% by weight of 1,1,1,2,2,4,5,5,5-nonafluoro-4-(trifluoromethyl)-3-pentanone (FK5-1-12), wherein the amount of the HFO-1233zd and FK5-1-12 together comprise at least about 80% by weight of the fire extinguishant; and (b) applying said fire extinguishant to the flame in an amount to produce a concentration in air of not greater than about 6 volume %.

9. The method of claim 8 wherein said fire extinguishants (i) has a boiling point of less than about 25° C. and (ii) produces a fire extinguishment speed of about 30 seconds or less.

10. The method of claim 9 wherein said applying step produces a concentration of said fire extinguishant in air of not greater than about 5 volume %.

11. The method of claim 10 wherein said applying comprises applying said fire extinguishant to an area having a temperature above about 80° F. and a relative humidity above about 70%.

12. The method of claim 11, wherein the fire extinguishant consists of HFO-1233zd(E) and FK5-1-12.

13. The method of claim 11, wherein said fire extinguishant produces a fire extinguishment speed of about 15 seconds or less.

* * * * *